US006196948B1

(12) United States Patent
Stearns et al.

(10) Patent No.: US 6,196,948 B1
(45) Date of Patent: Mar. 6, 2001

(54) ELLIPTICAL EXERCISE METHODS AND APPARATUS

(76) Inventors: Kenneth W. Stearns, P.O. Box 55912, Houston, TX (US) 77055; Joseph D. Maresh, P.O. Box 645, West Linn, OR (US) 97068-0645

( * ) Notice: Subject to any disclaimer, the term of this patent is extended or adjusted under 35 U.S.C. 154(b) by 0 days.

(21) Appl. No.: 09/561,553

(22) Filed: Apr. 28, 2000

Related U.S. Application Data

(63) Continuation-in-part of application No. 09/072,765, filed on May 5, 1998, and a continuation-in-part of application No. 09/273,861, filed on Mar. 22, 1999.

(51) Int. Cl.[7] ..... A63B 69/16; A63B 22/04
(52) U.S. Cl. ..... 482/52; 482/51; 482/70
(58) Field of Search ..... 482/51, 52, 53, 482/57, 70, 79, 80

(56) References Cited

U.S. PATENT DOCUMENTS 5,997,445 * 12/1999 Maresh et al. ..... 482/70
6,024,676 * 2/2000 Eschenbach ..... 482/51
6,042,512 * 3/2000 Eschenbach ..... 482/52
6,045,487 * 4/2000 Miller ..... 482/51
6,080,086 * 6/2000 Maresh et al. ..... 482/57
6,090,013 * 7/2000 Eschenbach ..... 482/51

* cited by examiner

*Primary Examiner*—Stephen R. Crow

(57) ABSTRACT

An exercise apparatus has a frame designed to rest upon a floor surface. Left and right cranks are rotatably mounted on the frame, and left and right rocker links are pivotally mounted on the frame. Left and right foot links have forward ends rotatably connected to respective rocker links, intermediate portions movably connected to respective cranks, and rearward ends sized and configured to support a person's feet. On the preferred embodiment, left and right rigid drawbars are selectively imposed between respective cranks and respective rocker links to convert exercise motion from a stepping type motion to a striding type motion.

20 Claims, 3 Drawing Sheets

ELLIPTICAL EXERCISE METHODS AND APPARATUS

CROSS REFERENCE TO RELATED APPLICATION

This application is a continuation-in-part of both U.S. patent application Ser. No. 09/072,765, which was filed on May 5, 1998, and U.S. patent application Ser. No. 09/273,861, which was filed on Mar. 22, 1999.

FIELD OF THE INVENTION

The present invention relates to exercise methods and apparatus, and the preferred embodiment is an elliptical motion exercise machine which alternatively facilitates stepping and striding motions.

BACKGROUND OF THE INVENTION

Exercise equipment has been designed to facilitate a variety of exercise motions. For example, treadmills allow a person to walk or run in place; stepper machines and climber machines allow a person to climb in place; bicycle machines allow a person to pedal in place; and still other machines allow a person to skate and/or stride in place. Yet another type of exercise equipment facilitates relatively more complicated exercise motions and/or better simulates real life activity. Such equipment typically links a relatively simple motion, such as circular, to a relatively more complex motion, such as elliptical. An object of the present invention is to provide an improved elliptical motion exercise machine.

SUMMARY OF THE INVENTION

In one respect, the present invention may be seen to provide a novel linkage assembly and corresponding exercise apparatus suitable for linking circular motion to relatively more complex, generally elliptical motion. On a preferred embodiment, left and right connector links have forward portions which are pivotally connected to respective rocker links; intermediate portions which are movably connected to respective cranks; and rearward portions which are sized and configured to support a person's feet. In a first mode of operation, the connector links are rotatably connected to respective cranks. In a second mode of operation, the connector links are rollably connected to respective cranks, and left and right drawbars are imposed between respective cranks and respective rocker links in a manner which amplifies the horizontal displacement of respective connector links.

In another respect, the present invention may be seen to facilitate foot travel through more than one fixed elliptical path. On the preferred embodiment, a first path has a generally vertical major axis and accommodates a stepping motion, and a second path has a generally horizontal major axis and accommodates a striding motion. Switching between the two types of paths is accomplished by imposing/removing a constraint on/from a first portion of the linkage assembly and conversely removing/imposing a constraint from/on a second portion of the linkage assembly. Additional features and advantages of the present invention may become more apparent from the detailed description that follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

The present invention provides exercise methods and apparatus which link rotation of left and right cranks to movement of left and right foot supporting members through generally elliptical paths. The terms "elliptical" and "generally elliptical" are used in a broad sense to describe a closed curved path of motion having a relatively longer first axis or major axis and a relatively shorter second axis or minor axis. The preferred methods and apparatus facilitate adjustment between a stepping type of elliptical foot motion, having a generally vertical major axis, and a striding type of elliptical foot motion, having a generally horizontal major axis. The terms "vertical" and "generally vertical" are used in a broad sense to describe an angle between fifty and ninety degrees relative to the ground or an underlying floor surface. Similarly, the terms "horizontal" and "generally horizontal" are used in a broad sense to describe an angle between zero and forty degrees relative to the ground or an underlying floor surface.

Figure 1:
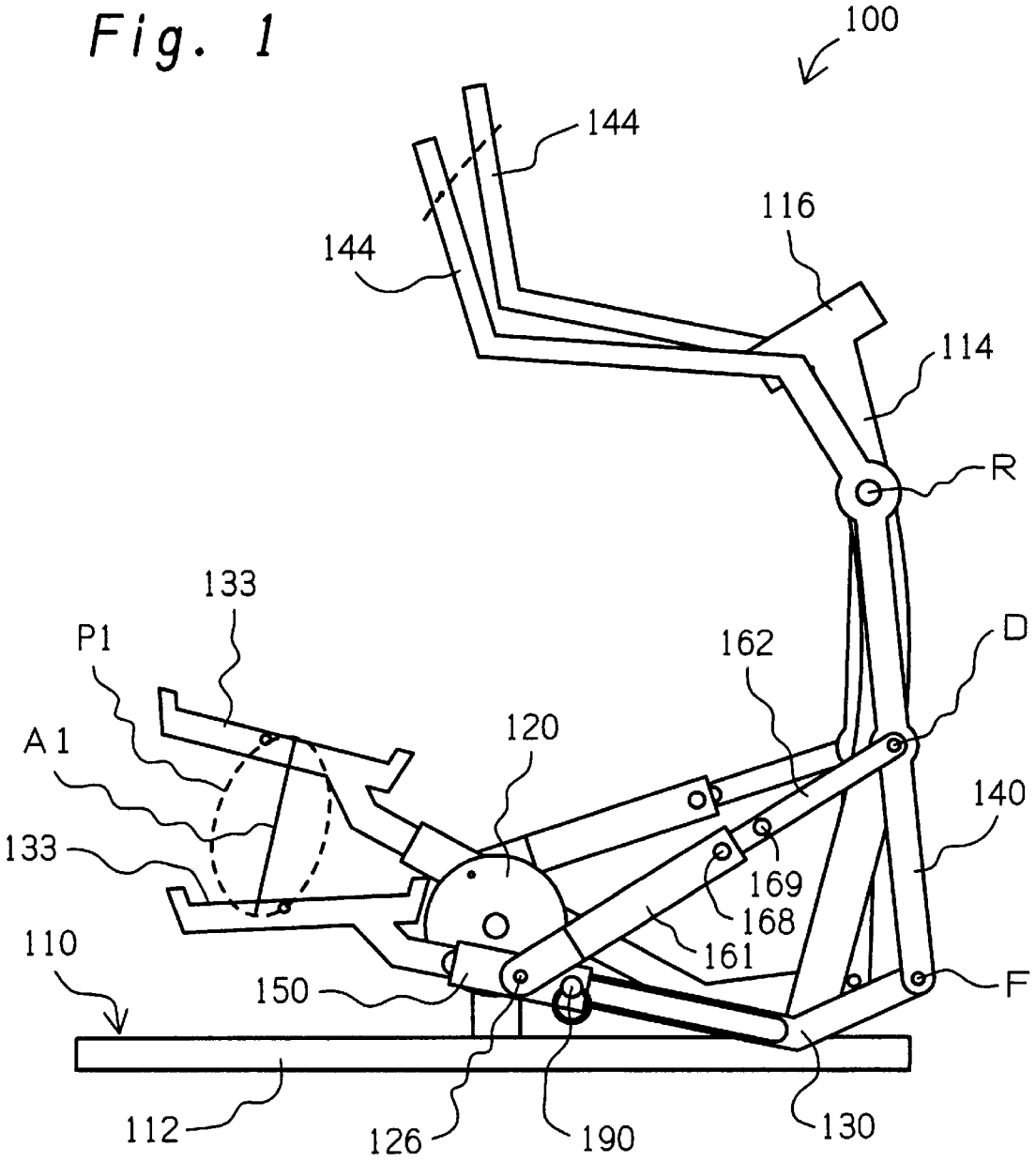
FIG. 1 is a side view of a preferred embodiment exercise apparatus constructed according to the principles of the present invention.
Figure 2:
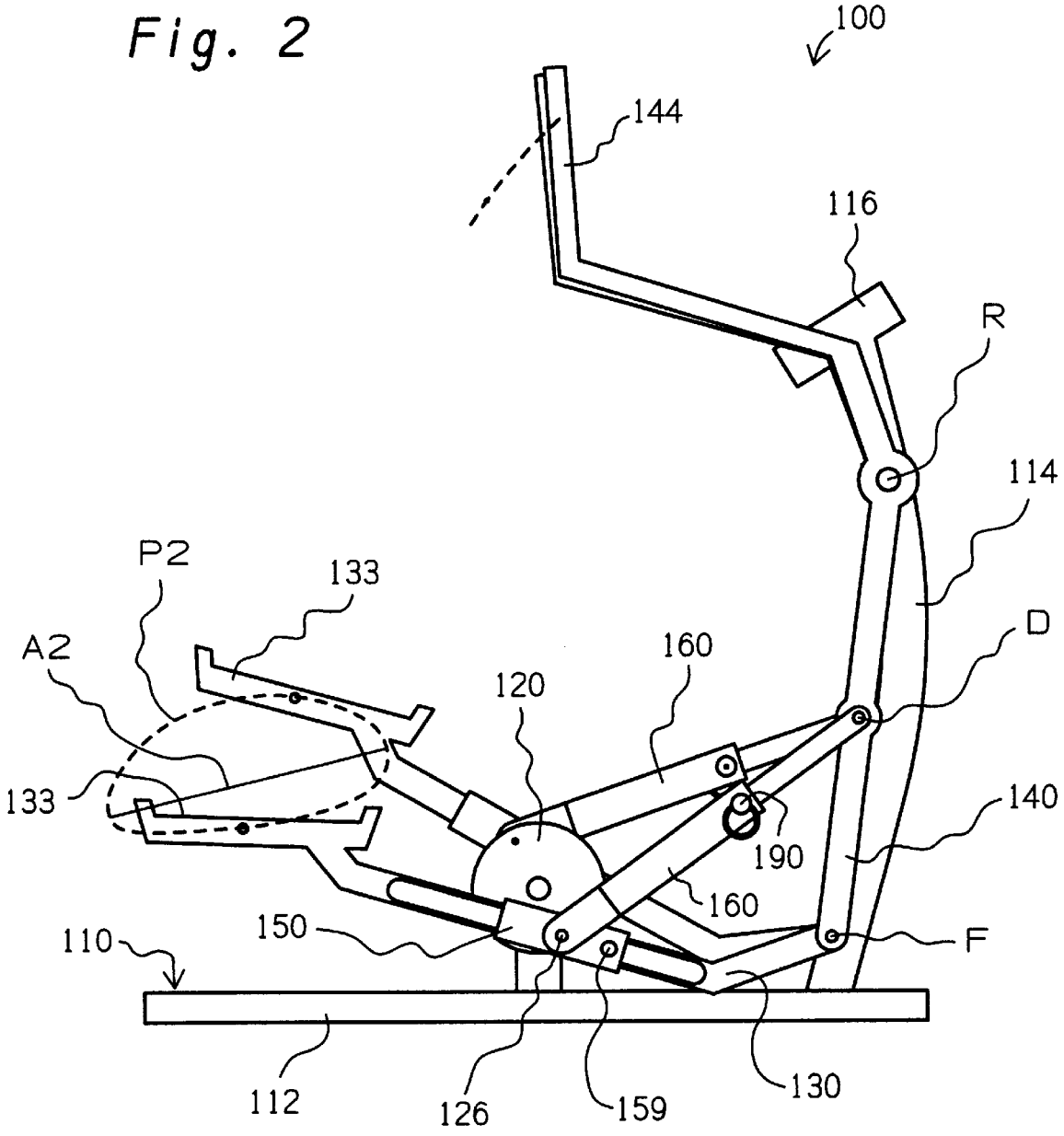
FIG. 2 is a side view of the exercise apparatus of FIG. 1 in an alternative configuration.

A preferred embodiment of the present invention is designated as 100 in FIGS. 1–2. When configured as shown in FIG. 1, the exercise apparatus 100 encourages a person's feet to travel through adjacent, generally elliptical paths P1, each of which has a generally vertical major axis A1 (which extends at an angle of approximately eighty degrees relative to horizontal). When configured as shown in FIG. 2, the exercise apparatus 100 encourages a person's feet to travel through adjacent, generally elliptical paths P2, each of which has a generally horizontal major axis A2 (which extends at an angle of approximately fifteen degrees relative to horizontal). On the preferred embodiment 100, the major axis A2 is approximately sixty percent longer than the major axis A1.

The apparatus 100 includes a frame 110 having a base 112 designed to rest upon a floor surface, and a stanchion 114 extending upward from an end of the base 112. A user interface device 116 may be mounted on top of the stanchion 114 to make various types of information and/or functions available to a user of the apparatus 100. Left and right linkage assemblies are movably mounted on the frame 110 to support a user and move his/her feet through either of the paths P1 and P2.

The apparatus 100 is generally symmetrical about a vertical plane extending lengthwise through the frame 110, the only exceptions being the relative orientation of linkage assembly counterparts on opposite sides of the plane of symmetry. In particular, the "right-hand" components are one hundred and eighty degrees out of phase relative to the "left-hand" components (although other phase relationships may be implemented without departing from the scope of the invention). Thus, when linkage components on only one side of the apparatus 100 are described, it is to be understood that corresponding parts are disposed on an opposite side of the apparatus. Those skilled in the art will also recognize that the portions of the apparatus 100 which are intersected by the plane of symmetry exist individually and thus, do not have any "opposite side" counterparts. Moreover, to the extent that reference is made to a forward or rearward end of the linkage assemblies, it is to be understood that a person could exercise while facing either direction relative thereto.

The left and right linkage assemblies include left and right cranks 120, respectively, which are rotatably mounted on the frame 110 and rotate about a common crank axis. The cranks 120 are shown as respective discs, either or both of which may be connected (in a manner known in the art) to a stepped-up flywheel or other inertia altering device. Those skilled in the art will also recognize that such devices may be connected to the user interface 116, as well, in order to provide information about the current mode of operation and/or to allow the user to adjust same.

The left and right linkage assemblies also include left and right foot supporting links 130, respectively. Each foot supporting link 130 has a first, intermediate portion supported by a respective support 150; a second, forward portion rotatably connected to a respective rocker link 140; and a third, rearward portion or foot platform 133 sized and configured to support a person's foot. A relatively upper portion of each rocker link 140 is rotatably connected to the frame 110 at a common pivot axis R. An upper distal end 144 of each rocker link 140 is sized and configured for grasping by a person standing on the rearward ends of the foot links 130. Those skilled in the art will recognize that fixed handlebars may be mounted on the frame 110 in lieu of the movable handlebars 144 and/or in addition thereto. Also, alternative movable handlebars may be provided on the frame 110 independent of the rocker links 140, and then linked to respective linkage assemblies and/or allowed to be independently operated.

Figure 3:
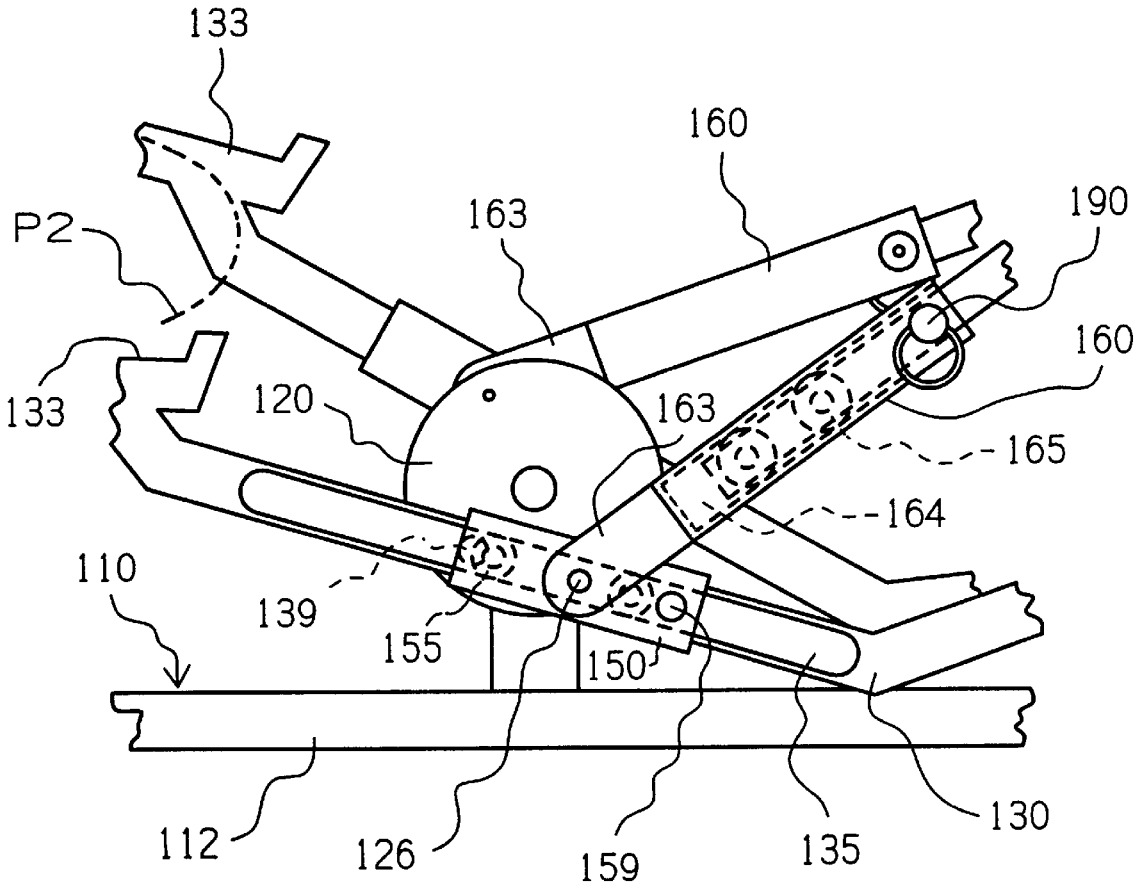
FIG. 3 is an enlarged side view of a portion of the exercise apparatus of FIG. 2.

FIG. 3 shows the right side support 150, the right side foot link 130, and the right side crank 120 in greater detail. The support 150 may be described as a bearing member having rollers 155 which are disposed within a slot 135 in the foot link 130. The rollers 155 may also be described as disposed beneath at least a portion of the foot link 130. A crank pin (which aligns with the pin 126 shown in FIG. 3) rotatably connects an inboard side of the support 150 to the crank 120. At a discrete location, a hole 159 extends through the support 150, and a similarly sized hole 139 extends through the inboard side of the foot link 130. When the support 150 and the foot link 130 are properly aligned relative to one another, a detent pin or other suitable fastener 190 may be inserted through the holes 159 and 139 to lock the support 150 and the foot link 130 in place relative to one another. In this configuration, shown in FIG. 1, the foot links 130 are rotatably connected to the crank at the position of respective posts 126, and the foot platforms 133 are constrained to move through the foot paths P1. Those skilled in the art will recognize that each of the supports 150 may be replaced by a crank mounted roller which is selectively locked against movement relative to a respective foot link 130.

Left and right cylinders 161 have rearward ends which are forked or split into inboard and outboard flanges 163. Each outboard flange 163 is rotatably connected to the outboard side of a respective support 150 by means of a respective pin 126. Each inboard flange 163 is rotatably connected to both a respective crank 120 and the inboard side of a respective support 150 by means of a respective crank pin (aligned with a respective pin 126). Left and right rods 162 have forward ends which are rotatably connected to respective rocker links 140 at pivot joints D (below the common pivot axis R and above respective foot link joints F). Opposite, rearward portions of the rods 162 are inserted into openings 164 defined in relatively forward portions of respective cylinders 161. Rollers 165 may be mounted on the rearward ends of the rods 162 to facilitate telescoping of the rods 162 relative to respective cylinders 161. When the apparatus 100 is configured as shown in FIG. 1, the telescoping members 161 and 162 have no effect on the operation of the apparatus 100 and/or the configuration of the foot paths P1.

A hole 168 extends through each cylinder 161, and a similarly sized hole 169 extends through each rod 162. When the rods 162 and the cylinders 161 are properly aligned relative to one another, the left and right detent pins or other suitable fasteners 190 (having been removed from respective holes 139 and 159 on the preferred embodiment 100) may be inserted through respective holes 168 and 169 to lock the rods 162 and the cylinders 161 in place relative to one another. In this configuration, shown in FIGS. 2–3, the foot links 130 are movable relative to respective supports 150 and respective cranks 120 (as if supported on respective crank mounted rollers), and the members 161 and 162 cooperate to define rigid drawbars 160 which constrain the foot platforms 133 to move through the foot paths P2. The drawbars 160 impose greater horizontal displacement upon the foot platforms 133 because the "swing arm" distance defined between the drawbar pivot joints D and the rocker pivot axis R is less than the "swing arm" distance defined between the foot link pivot joints F and the rocker pivot axis R. As a result of this arrangement, the rocker links 140 are constrained to pivot back and forth relative to the frame 110 as the cranks 120 rotate, and the foot links 130 are constrained to move back and forth relative to the supports 150 as the rocker links 140 reciprocate.

The foregoing description of the present invention is made with reference to a preferred embodiment and a particular application. However, the scope of the present invention is not so limited, and those skilled in the art will recognize additional embodiments, modifications, and/or applications which fall within the scope of the present invention. Among other things, the components of the linkage assembly may be arranged and/or interconnected in alternative ways without departing from the scope of the present invention, and the spatial relationships may vary for different sizes, configurations, and/or arrangements of the components of the linkage assembly. Also, each of the linkage components on the apparatus 100 is necessarily long enough to facilitate the required interconnections but need not terminate immediately beyond its terminal connection points.

The present invention may be described in terms of an exercise apparatus 100 having user supporting, linkage assemblies which support a person in a standing position relative to an underlying floor surface. The linkage assemblies are interconnected between the frame 110 and respective left and right cranks 120 in a manner that links rotation of the cranks to elliptical movement of the foot platforms 133 and reciprocal movement of the handles 144. The linkage assemblies include means for alternatively providing an elliptical stepping motion and an elliptical striding motion.

The present invention may also be described in terms of various methods relating to and/or facilitated by the exercise apparatus 100. For example, the present invention provides a method of alternatively performing an elliptical stepping exercise and an elliptical striding exercise. In this regard, an exercise machine is provided with a frame designed to rest upon a floor surface, and left and right linkage assemblies which are movably mounted on the frame and constrain respective left and right foot supports to move through elliptical paths. The machine may be configured to generate elliptical paths having a generally vertical major axis by imposing a linkage constraint on respective first portions of the linkage assemblies and removing a linkage constraint from respective second portions of the linkage assemblies. The machine may be alternatively configured to generate elliptical paths having a generally horizontal major axis by removing the linkage constraint on the respective first portions of the linkage assemblies and imposing the linkage constraint on the respective second portions of the linkage assemblies.

With the foregoing in mind, the scope of the present invention is to be limited only to the extent of the claims which follow.

What is claimed is:

1. An exercise apparatus, comprising:

a frame designed to rest upon a floor surface;

a left crank and a right crank, wherein each said crank is rotatably mounted on the frame;

a left rocker link and a right rocker link, wherein each said rocker link is pivotally mounted on the frame;

a left foot link and a right foot link, wherein each said foot link has a first end rotatably connected to a respective rocker link, and an opposite, second end sized and configured to support a person's foot;

a left support and a right support, wherein each said support is operatively connected to an intermediate portion of a respective foot link, and each said support is rotatably connected to a respective crank;

a left rigid drawbar selectively imposed between the left support and the left rocker link, wherein in a first mode of operation, the left foot link is secured against movement relative to the left support, and the left rigid drawbar is not imposed between the left support and the left rocker link, and in a second mode of operation, the left foot link is movable relative to the left support, and the left rigid drawbar is imposed between the left support and the left rocker link; and a right rigid drawbar selectively imposed between the right support and the right rocker link, wherein in the first mode of operation, the right foot link is secured against movement relative to the right support, and the right rigid drawbar is not imposed between the right support and the right rocker link, and in a second mode of operation, the right foot link is movable relative to the right support, and the right rigid drawbar is imposed between the right support and the right rocker link.

2. The exercise apparatus of claim 1, wherein each said drawbar comprises a rod and a cylinder which selectively telescope relative to one another.

3. The exercise apparatus of claim 2, wherein in the second mode of operation, a respective pin extends through aligned holes extending transversely through the rod and the cylinder of a respective drawbar.

4. The exercise apparatus of claim 3, wherein in the first mode of operation, each said pin extends through aligned holes extending transversely through a respective support and a respective foot link.

5. The exercise apparatus of claim 1, wherein in the first mode of operation, a first pin extends through aligned holes extending transversely through the left support and the left foot link, and a second pin extends through aligned holes extending transversely through the right support and the right foot link.

6. The exercise apparatus of claim 1, wherein each said foot link is rotatably connected to a lower end of a respective rocker link.

7. The exercise apparatus of claim 6, wherein each said drawbar link is rotatably connected to an intermediate portion of a respective rocker link.

8. The exercise apparatus of claim 7, wherein in the second mode of operation, a reference point on each said second end travels through a generally elliptical path having a generally horizontal major axis.

9. The exercise apparatus of claim 8, wherein in the first mode of operation, a reference point on each said second end travels through a generally elliptical path having a generally vertical major axis.

10. The exercise apparatus of claim 9, wherein the horizontal major axis is longer than the vertical major axis.

11. The exercise apparatus of claim 1, wherein an upper distal end of each said rocker link is configured for grasping by a person standing on the second end of each said foot link.

12. An exercise apparatus, comprising:

a frame designed to rest upon a floor surface;

a left crank and a right crank, wherein each said crank is rotatably mounted on the frame;

a left rocker link and a right rocker link, wherein each said rocker link is pivotally mounted on the frame;

a left foot link and a right foot link, wherein each said foot link has a first portion rotatably connected to a respective rocker link, and a second portion bearing a respective foot platform sized and configured to support a person's foot;

a left support and a right support, wherein each said support is operatively connected to a third portion of a respective foot link, and each said support is rotatably connected to a respective crank;

a left linking means for linking the left support to the left rocker link in a first manner to link rotation of the left crank to movement of a respective foot platform through a generally elliptical stepping motion, and for alternatively linking the left support to the left rocker link in a second manner to link rotation of the left crank to movement of a respective foot platform through a generally elliptical striding motion; and a right linking means for linking the right support to the right rocker link in a first manner to link rotation of the right crank to movement of a respective foot platform through a generally elliptical stepping motion, and for alternatively linking the right support to the right rocker link in a second manner to link rotation of the right crank to movement of a respective foot platform through a generally elliptical striding motion.

13. The exercise apparatus of claim 12, wherein each said linking means includes a rigid drawbar imposed between a respective support and a respective rocker link to generate the striding motion.

14. The exercise apparatus of claim 13, wherein each said rigid drawbar is rotatably connected to a respective rocker link at a location spaced upward from where a respective foot link is rotatably connected to the respective rocker link.

15. The exercise apparatus of claim 13, wherein each said linking means includes a rigid pin interconnected between a respective support and a respective foot link to generate the stepping motion.

16. The exercise apparatus of claim 12, wherein each said linking means includes a rigid pin interconnected between a respective support and a respective foot link to generate the stepping motion.

17. The exercise apparatus of claim 12, wherein the striding motion has a generally horizontal major axis, and the stepping motion has a generally vertical major axis, and the vertical major axis is at least twenty-five percent shorter than the horizontal major axis.

18. The exercise apparatus of claim 12, wherein an upper distal end of each said rocker link is configured for grasping by a person standing on the second portion of each said foot link.

19. The exercise apparatus of claim 12, wherein at least one roller is rotatably mounted on each said support, and each said foot link is supported by at least one said roller.

20. A method of alternatively performing an elliptical stepping exercise and an elliptical striding exercise, comprising the steps of:

providing an exercise machine with a frame designed to rest upon a floor surface, and left and right linkage assemblies which constrain respective left and right foot supports to move through elliptical paths;

configuring the machine to generate elliptical paths having a generally vertical major axis by imposing a linkage constraint on respective first portions of the linkage assemblies and removing a linkage constraint from respective second portions of the linkage assemblies; and alternatively configuring the machine to generate elliptical paths having a generally horizontal major axis by removing the linkage constraint from the respective first portions of the linkage assemblies and imposing the linkage constraint on the respective second portions of the linkage assemblies.

* * * * *